US011613961B2

(12) United States Patent
Malkawi et al.

(10) Patent No.: US 11,613,961 B2
(45) Date of Patent: Mar. 28, 2023

(54) FLOW CONTROL DEVICE INCLUDING A CANTILEVER RESTRICTOR

(71) Applicants: Ameen Malkawi, Dhahran (SA); Shiv Shankar Sangaru, Dhahran (SA); Raghava Raju Lakhamraju, Dhahran (SA); Ahmed AlAdawy, Dhahran (SA); Naeem-Ur Minhas, Dhahran (SA); Hedy Suherdiana, Al Khobar (SA); Robbie Arsyadanie, Al Khobar (SA)

(72) Inventors: Ameen Malkawi, Dhahran (SA); Shiv Shankar Sangaru, Dhahran (SA); Raghava Raju Lakhamraju, Dhahran (SA); Ahmed AlAdawy, Dhahran (SA); Naeem-Ur Minhas, Dhahran (SA); Hedy Suherdiana, Al Khobar (SA); Robbie Arsyadanie, Al Khobar (SA)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 105 days.

(21) Appl. No.: 16/731,795

(22) Filed: Dec. 31, 2019

(65) Prior Publication Data

US 2021/0198976 A1 Jul. 1, 2021

(51) Int. Cl.

| | |
|---|---|
| ***E21B 34/08*** | (2006.01) |
| ***E21B 49/08*** | (2006.01) |
| ***E21B 47/10*** | (2012.01) |

(52) U.S. Cl.
CPC ..... *E21B 34/08* (2013.01); *E21B 47/10* (2013.01); *E21B 49/08* (2013.01)

(58) Field of Classification Search
CPC ..... E21B 34/08
See application file for complete search history.

(56) References Cited

U.S. PATENT DOCUMENTS

| | | | | |
|---|---|---|---|---|
| 2011/0017470 | A1* | 1/2011 | Xu | E21B 34/08 166/373 |
| 2014/0231095 | A1* | 8/2014 | Lopez | E21B 43/12 166/373 |
| 2014/0361490 | A1* | 12/2014 | Jonsson | F16J 15/44 277/307 |
| 2018/0128341 | A1* | 5/2018 | Mizuno | F16F 9/512 |

* cited by examiner

*Primary Examiner* — Cathleen R Hutchins
(74) *Attorney, Agent, or Firm* — Cantor Colburn LLP

(57) ABSTRACT

A fluid control device includes a housing, a fluid channel defined within the housing, the fluid channel having an inlet, and a restriction assembly. The restriction assembly includes a cantilever device disposed within the fluid channel and defining a restricted fluid path, the cantilever device configured to deform to reduce an area of the restricted fluid path and restrict a flow rate of fluid flowing therethrough based on a property of the fluid.

20 Claims, 11 Drawing Sheets

FLOW CONTROL DEVICE INCLUDING A CANTILEVER RESTRICTOR

BACKGROUND

Some forms of energy production involve a number of diverse activities from various engineering fields to be performed in a borehole. For example, exploration and production of hydrocarbons utilizes boreholes drilled into a resource bearing formation. For production operations, flow control devices are often used to control the flow of formation fluid into a borehole.

Flow control devices, such as inflow control devices (ICDs), are often employed in hydrocarbon production systems having multiple production zones, to increase efficiency by regulating the amount of flow through each zone. For example, in zones where formation fluid has a high proportion of water or other undesired fluids, ICDs can be used to choke off the flow to restrict inflow into those zones. Thus, inflow of formation fluids can be restricted to those zones having lower proportions of the undesired fluids (and a higher proportion of gas, oil and other hydrocarbons).

SUMMARY

An embodiment of a fluid control device includes a housing, a fluid channel defined within the housing, the fluid channel having an inlet, and a restriction assembly. The restriction assembly includes a cantilever device disposed within the fluid channel and defining a restricted fluid path, the cantilever device configured to deform to reduce an area of the restricted fluid path and restrict a flow rate of fluid flowing therethrough based on a property of the fluid.

An embodiment of a method of controlling fluid flow includes receiving fluid at an inlet of a fluid channel in a housing of a flow control device, the fluid channel defined within the housing, and controlling a flow rate of the fluid through the fluid channel by a restriction assembly. The restriction assembly includes a cantilever device disposed within the fluid channel and defining a restricted fluid path. Controlling the flow rate includes deforming the cantilever device to reduce an area of the restricted fluid path and restrict the flow rate of the fluid based on a property of the fluid.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
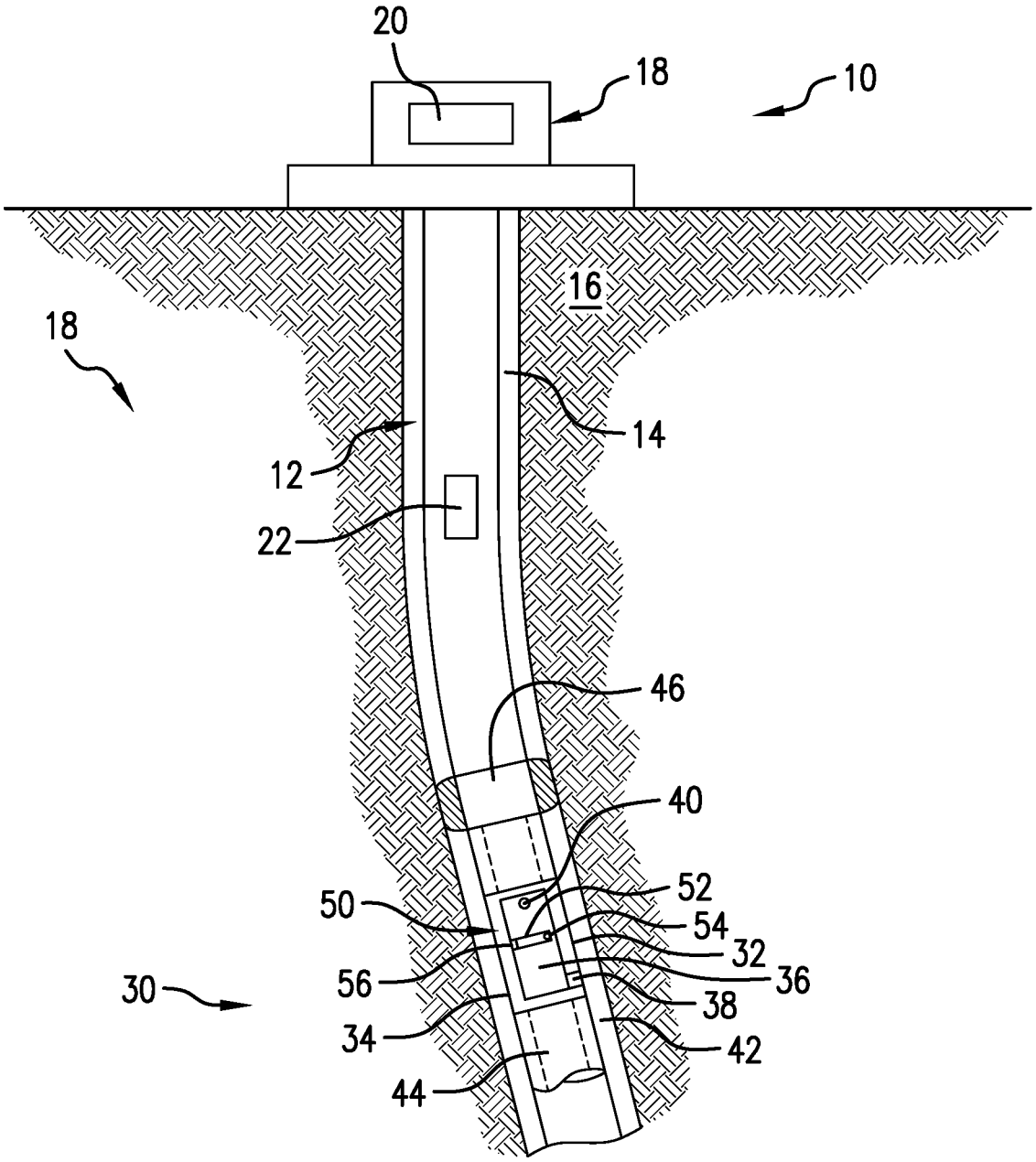
FIG. 1 depicts a resource production system including an embodiment of a flow control device.

A detailed description of one or more embodiments of the disclosed apparatus and method are presented herein by way of exemplification and not limitation with reference to the Figures.

Systems, devices and methods for control of fluid flow are described herein. An embodiment of a flow control device includes a body or housing having at least one fluid channel, and a restriction assembly disposed in fluid communication with the fluid channel. The restriction assembly includes at least one cantilever device that is disposed within the fluid channel and defines at least part of a restricted flow path, which can be adjusted to control the flow rate of fluid through the fluid channel.

The cantilever device is configured to restrict fluid flow based on variations in fluid properties, such as density and momentum. In one embodiment, the restriction assembly includes at least one cantilever body, which is fixedly attached to the body at one or more rigid attachment portions. The cantilever body has geometric (e.g., size, width, height) and/or material characteristics (e.g., material type, flexibility, stiffness) selected so that the cantilever body bends or otherwise deforms in response to fluid having a selected density (or other fluid property).

For example, the cantilever body has characteristics selected so that fluid having a density at or above a selected threshold causes the cantilever body to bend to reduce the flow area of the restricted flow path and/or temporarily eliminate the restricted flow path to entirely choke off or block fluid flow. Low density fluid, such as formation fluid having a high proportion of hydrocarbons, exerts a relatively low force on the cantilever body, so that the cantilever body bends to a relatively low degree or retains its shape, thereby permitting flow therethrough. Conversely, higher density fluid, such as formation fluid having a high proportion of water, exerts a relatively high force on the cantilever body, causing the cantilever body to deform and restrict fluid flow therethrough.

In one embodiment, the flow control device is configured to be deployed in a borehole in a subterranean region as, for example, part of a production string. For example, the flow control device is an inflow control device (ICD) configured to control the flow of formation fluid into a production conduit. The ICD includes one or more restriction assemblies having cantilevers configured to bend in response to fluid having a density above a selected threshold. In this way, the ICD can passively restrict the flow of fluid from a formation region when the fluid has an unacceptably high proportion of water, thus increasing hydrocarbon production efficiency and preventing water breakthrough.

The embodiments described herein present numerous advantages. For example, flow control devices as described herein have an increased sensitivity to changes in fluid content and can more effectively regulate flow (e.g., to choke water and favor light oil and other hydrocarbons) as compared to conventional devices. In addition, such flow control devices can be completely passive, and operate to regulate production without any other moving parts, intervention or electronics. Furthermore, the flow control devices can be configured to regulate fluids having different flow rates, densities and other properties, allowing for effective flow control under a variety of conditions. As movement of the cantilevers is reversible, the flow control devices can respond to changes in well conditions. For example, if a flow control device in a production zone restricts inflow due to an increase in water content, the flow control device can passively respond by restoring fluid flow if conditions change causing a decrease in the water content.

Referring to FIG. 1, an embodiment of a resource production system 10 includes a borehole string 12 disposed in a borehole 14 extending into a resource bearing formation such as an earth formation 16. The borehole string 12 is configured as, for example, a production string that establishes a production conduit through which production fluid is brought to the surface. As described herein, "borehole" or "wellbore" refers to a hole that makes up all or part of a drilled well. It is noted that the borehole 14 may include vertical, deviated and/or horizontal sections, and may follow any suitable or desired path. As described herein, "formations" refer to the various features and materials that may be encountered in a subsurface environment and surround the borehole 14.

The formation 16 may be a hydrocarbon bearing formation or strata that includes, e.g., oil and/or natural gas. In one embodiment, the system 10 is configured for production of hydrocarbons, but is not so limited. The system 10 may be configured for various purposes, such as well drilling operations, completions, resource extraction and recovery, steam assisted gravity drainage (SAGD), $CO_2$ sequestration, geothermal energy production and other operations for which fluid flow control is desired.

The system 10 also includes surface equipment 18 such as a drill rig, rotary table, top drive, blowout preventer and/or others to facilitate deploying the borehole string 12 and/or controlling downhole components. For example, the surface equipment 18 includes a fluid control system for controlling production and circulation of fluid, which may include one or more pumps in fluid communication with a fluid tank or other fluid source.

Aspects of the system 10 may be controlled actively via the surface equipment 18 or be configured for passive operation. The system 10 may include a processing device such as a surface processing unit 20, and/or a subsurface processing unit 22 disposed in the borehole 14 and connected to one or more downhole components. The surface processing unit 22 and/or the subsurface processing unit 22 includes components such as a processor, an input/output device and a data storage device (or a computer-readable medium) for storing data, files, models, data analysis modules and/or computer programs. The processing device may be configured to perform functions such as controlling downhole components, controlling fluid circulation, monitoring components during deployment, transmitting and receiving data, processing measurement data and/or monitoring operations.

Various tools and/or sensors may be incorporated in the system. For example, one or more measurement tools can be deployed downhole for measuring parameters, properties or conditions of the borehole, formation and/or downhole components. Examples of sensors include temperature sensors, pressure sensors, flow measurement sensors, resistivity sensors, porosity sensors (e.g., nuclear sensors or acoustic sensors), fluid property sensors and others. Various components may be configured to communicate with a surface location and/or a remote location, for example, via one or more conductors (e.g., hydraulic lines, electrical conductors and/or optical fibers) and/or wireless telemetry (e.g., mud pulse, electromagnetic, etc.)

The borehole string 12 supports a production assembly 30 that includes a fluid flow control device 32 such as an inflow control device (ICD). The flow control device 32 includes a housing or body 34 having a fluid channel 36. The fluid channel 36 establishes a fluid flow path from an inlet 38 to an outlet 40. In one embodiment, the inlet 38 is in fluid communication with fluid in an annulus 42 of the borehole 14 and the outlet 40 is in fluid communication with a production conduit 44 in the borehole string 12. The flow control device 32, in one embodiment, is configured as an inflow control device (ICD) as part of a production system. The flow control device 32 is not so limited, and can be utilized in conjunction with any energy industry system or other system for which fluid flow control is desired.

The fluid channel 36 can extend in any suitable direction and define any suitable fluid flow path. For example, the fluid channel 36 (or multiple fluid channels 36) can follow a linear path along a longitudinal axis of the borehole string 12 and/or the production assembly 30, or a nonlinear path, such as a curved, circumferential, circular, ring-shaped or spiral path.

The production assembly 30 may include other components for facilitating production, stimulation and/or fluid injection. For example, the production assembly 30 includes or is operably connected to a packer 46 for isolating sections of the borehole 14 and/or regions of the formation 16, e.g., to create one or more production zones. Other components include, for example, sand screens, sleeves, injection devices, perforation devices and others. Although a single production assembly 30 and flow control device 32 are shown, it should be understood that multiple assemblies and/or flow control devices may be arrayed along the borehole string 12 to establish multiple stages and/or production zones.

The fluid channel 36 includes or is in fluid communication with one or more restriction assemblies 50, each of which includes a cantilever device 52 that is configured to bend or otherwise deform based on a property of fluid flowing through the channel 36. The cantilever device 52 includes a deformable body 54 that is fixedly attached to the device body 34 and/or the fluid channel 36 via an attachment portion 56, which may be integral with the cantilever body 54 or a separate component attached thereto.

The cantilever body 54 has characteristics such as thickness and length, and elastic properties, selected so that fluid having a selected property value (e.g., above some threshold) will cause the cantilever body 54 to deform in order to control the flow rate.

In one embodiment, the cantilever device 52 is sensitive to changes in fluid flow rate and/or density. Fluid having a given density (for a given flow rate) will apply a corresponding force on the cantilever device 52, which causes some degree of bending. The amount of force may be proportional to the density, and thereby fluid having different densities will result in a different degree of bending.

In one embodiment, the cantilever device 52 is configured to have two states, i.e., an open state when the cantilever device 52 is not deformed, and a closed state when the cantilever device 52 is deformed (has bended) and prevents any fluid flow. In another embodiment, the cantilever device 52 is configured to experience varying degrees of deformation or bending based on different densities, and can thus have more than two states. For example, the cantilever device 52 can have a closed state, a fully open state, and one or more intermediate states in which the cantilever device 52 is partially open to varying degrees.

Figure 2:
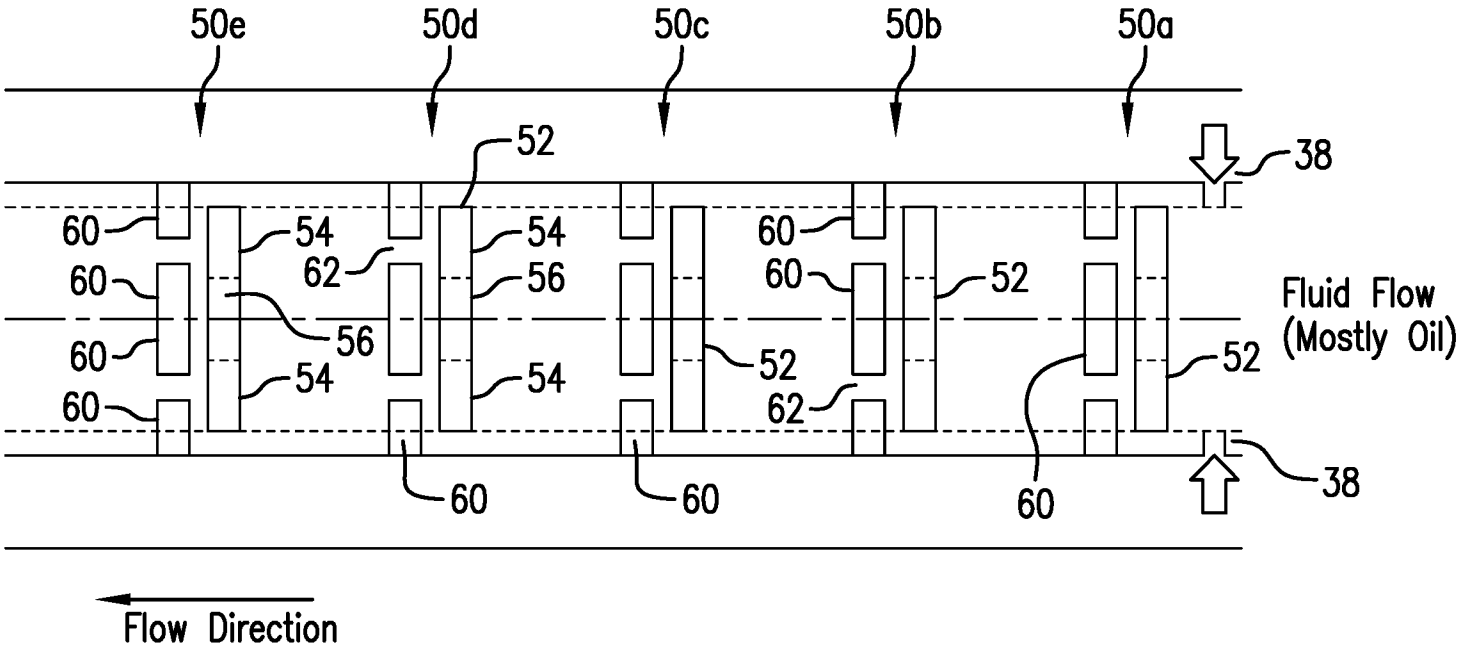
FIG. 2 depicts an embodiment of a flow control device having one or more restriction assemblies, where each restriction assembly includes a cantilever device configured to control the flow rate of fluid therethrough based on one or more fluid properties.
Figure 3:
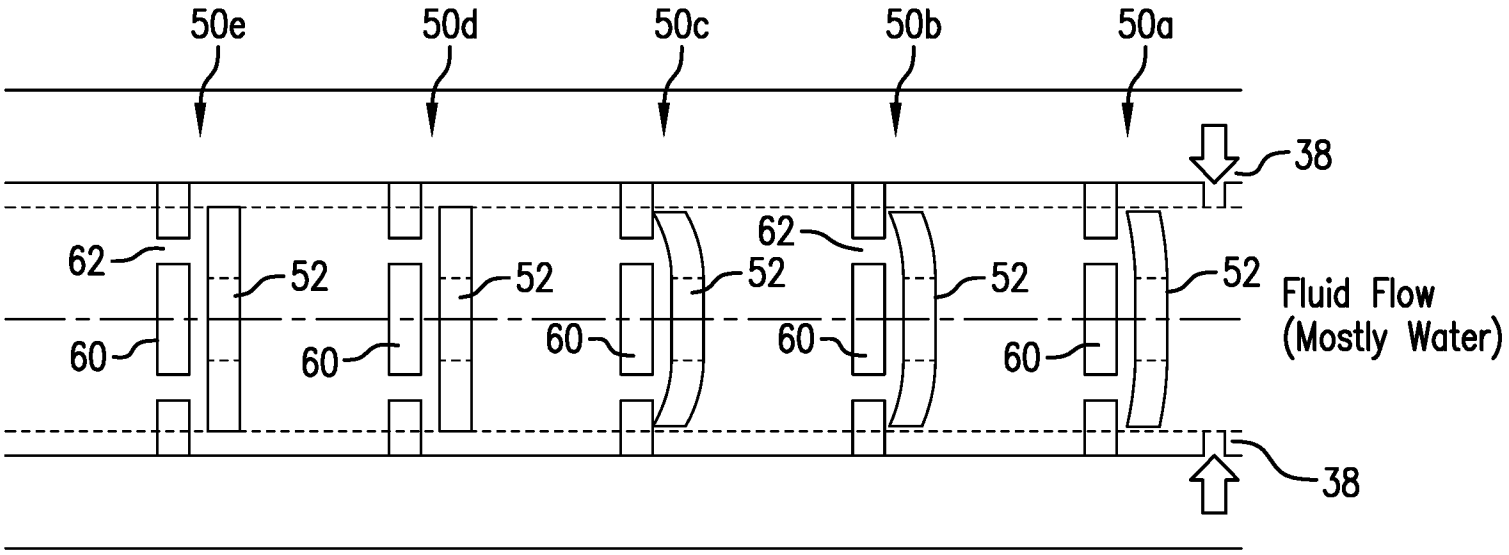
FIG. 3 depicts the flow control device of FIG. 2, and illustrates a response of restriction assemblies to a change in the flow rate and/or density of the fluid.

FIGS. 2 and 3 depict an embodiment of the flow control device 32. In this embodiment, the flow control device 32 (e.g., an ICD) includes multiple restriction assemblies 50. Each restriction assembly 50 may represent an individual flow control stage, and be configured to exhibit the same degree of bending for a given flow rate and density, or can be configured to exhibit different degrees of bending in order to meet desired flow control requirements. It is noted that there may be any number of cantilever devices per stage or restriction assembly 50.

In the embodiment of FIGS. 2 and 3, individual restriction assemblies 50 are denoted as stages 50*a*-50*e*. Each restriction assembly 50, in this embodiment, includes a cantilever device 52 having a fixed portion 56 that is rigidly attached to the fluid channel 36 and/or the device body 34, and a cantilever body 54 that is attached to the fixed portion 56 at one end and is free to bend in response to forces exerted by fluid.

In one embodiment, each restriction assembly 50 also includes a rigid flow control component 60. Each rigid flow control component 60 includes one or more flow ports 62 that define a fluid path having a minimum cross-sectional area (in a direction perpendicular to the direction of fluid flow) that is less than the cross-sectional area of the fluid channel 36. As discussed herein, a "rigid" body refers to a body having sufficient rigidity so that the body does not deform with respect to the fluid channel 36 in response to fluid flow.

The restriction assemblies 50 may be attached or connected to the fluid channel 36 and/or the body 54 in any suitable manner. For example, the rigid flow control body 60 and/or the cantilever device 52 may be separate components that are attached via mechanical attachments. In another example, the rigid flow control body 60 and/or the cantilever device 52 are integral with the body 34, e.g., via casting, stamping, printing and/or machining.

In one embodiment, each cantilever device 52 has geometric and material properties that are selected so that the cantilever device 52 exhibits a selected degree of bending for a given fluid density and flow rate. In one embodiment, the cantilever devices 52 are designed to be passive devices, in that the cantilever devices 52 respond to fluid properties without any active control (e.g., by electrical or hydraulic control lines).

The cantilever devices 52 in each stage may have the same characteristics, or have different characteristics. For example, as shown in FIG. 3, the cantilever bodies 52 may have successively higher resistance to fluid density. For example, the restriction assemblies 50 have increasing bend response to a given density and flow rate as fluid flows through the fluid channel 36 in a flow direction that extends from stage 50*a* to stage 50*e*. In the example of FIG. 3, the cantilever device of stage 50*a* exhibits a relatively low degree of bending or deflection in response to fluid density, and the devices have successively higher degrees of bending as the stages progress from 50*a* to 50*e*.

Thus, as demonstrated in FIG. 3, when fluid has a density associated with a high proportion of water, the cantilever device at stage 50*a* bends to a relatively low degree, which restricts flow but permits some flow therethrough. The cantilever device at stage 50*b* bends to a higher degree and provides a smaller restriction. The cantilever device at stage 50*c* bends to an even greater degree, such that the ends of the cantilever body 52 at stage 50*c* impinges on the rigid flow control component 60 and completely blocks flow. In this way, fluid flow can be gradually restricted to handle the changes in the pressure drop at each stage.

Embodiments described herein are not limited to the geometric and material properties shown in FIGS. 2 and 3. As discussed above, each restriction assembly 50 can have any combination of properties, and have the same or different responses to fluid density. For example, individual cantilever devices 52 and/or restriction assemblies 50 can be configured to bend so that flow control based on density can be handled for different flow rates.

As an illustration, the cantilever devices 52 of stages 50*a*-50*e* can have successively decreasing thicknesses and/or successively increasing modules of elasticity so that, as density or flow rate increases, earlier stages (in the order from 50*a* to 50*e*) will deform to reduce or cut off flow of fluid having a cutoff or threshold density. For example, when fluid at a given low flow rate has a sufficient density (corresponding to water in the fluid having a proportion equal to or greater than a threshold), a later stage such as stage 50*b* will deform to cut off flow, and an earlier stage such as stage 50*a* will stay at least partially open.

In designing a cantilever device, properties including the geometry of the cantilever device and the fluid channel, and material elasticity, may be taken into consideration. The geometry of the cantilever device has a significant effect on the drag force ($F_D$) exerted by fluid, and the elasticity significantly effects the amount of deflection for a given drag force.

The drag force $F_D$ can be expressed by the following equation:

$$F_D = C_D \rho A \frac{v^2}{2},$$

where "ρ" is the overall fluid density, "A" is the flow area defined by the geometry (e.g., width, height, diameter, etc.) of the fluid channel, and "v" is fluid velocity. "$C_D$" is a constant of proportionality that is based on the geometries of the cantilever device and the fluid channel.

For a fluid having a mixture of oil and water, the fluid density may be selected based on a desired proportion of water in the fluid. As the proportion of water increases, the overall fluid density increases. Thus, for a given geometry, the cantilever elasticity can be selected to produce a desired deflection in response to an overall fluid density that meets or exceeds a threshold density.

Based on the calculated drag force $F_D$, the cantilever material properties and geometry can be selected so that a cantilever device exhibits a selected deflection in response to the force applied by a fluid having at least a selected proportion of water. For example, the material and geometric properties are selected so that the cantilever device exhibits a selected amount of deflection in response to fluid having an overall density that corresponds to an unacceptably high proportion of water. Thus, the device is designed to restrict flow to maintain a desired oil production efficiency and prevent water breakthrough.

FIGS. 4-13 depict various examples of a flow control device including one or more restriction assemblies 50. In these examples, the flow control device is configured as an inflow control device (ICD) 70 that includes a cylindrical housing 72 having a selected outside diameter OD (e.g., 200 mm), and a central fluid conduit 74 having an inside diameter ID (e.g., 100 mm). The housing 72 includes an annular fluid channel 76 having an inlet (not shown) in fluid communication with an exterior of the housing 72, and an outlet (not shown) in fluid communication with the central fluid conduit 74. The annular fluid channel 76 may be fully annular (i.e., completely surrounding the central fluid conduit 74) or partially annular. The ICD 70, when deployed in a borehole, receives formation fluid through the inlet and transports the received fluid to a production conduit via the central fluid conduit 74.

In these examples, each cantilever device 52 includes a cantilever body 54 that is partially annular, i.e., extends circumferentially about part of a circumference of the annular fluid channel 76. Likewise, each restriction assembly 50 includes a rigid flow control component 60 that extends circumferentially and defines one or more fluid ports 62. The fluid port(s) 62 and the cantilever device(s) 52 in a restriction assembly 50 define a restricted fluid path having a minimum flow area (throat) that changes based on an amount of deformation or deflection of each cantilever device 52.

FIGS. 4-7 depict a section of an exemplary ICD 70 including a housing 72 extending axially (along the x-axis) in a direction corresponding to a longitudinal axis of the ICD 70 and/or other components of a borehole string. In this example, two cantilever devices 52 each include a cantilever body that extends circumferentially around the central fluid conduit 74 and are each attached to a rigid attachment portion 56 that is fixedly attached to an outer surface of the fluid channel 76. An upper gap 78 and a lower gap 80 are defined by the two cantilever devices 54.

Figure 4:
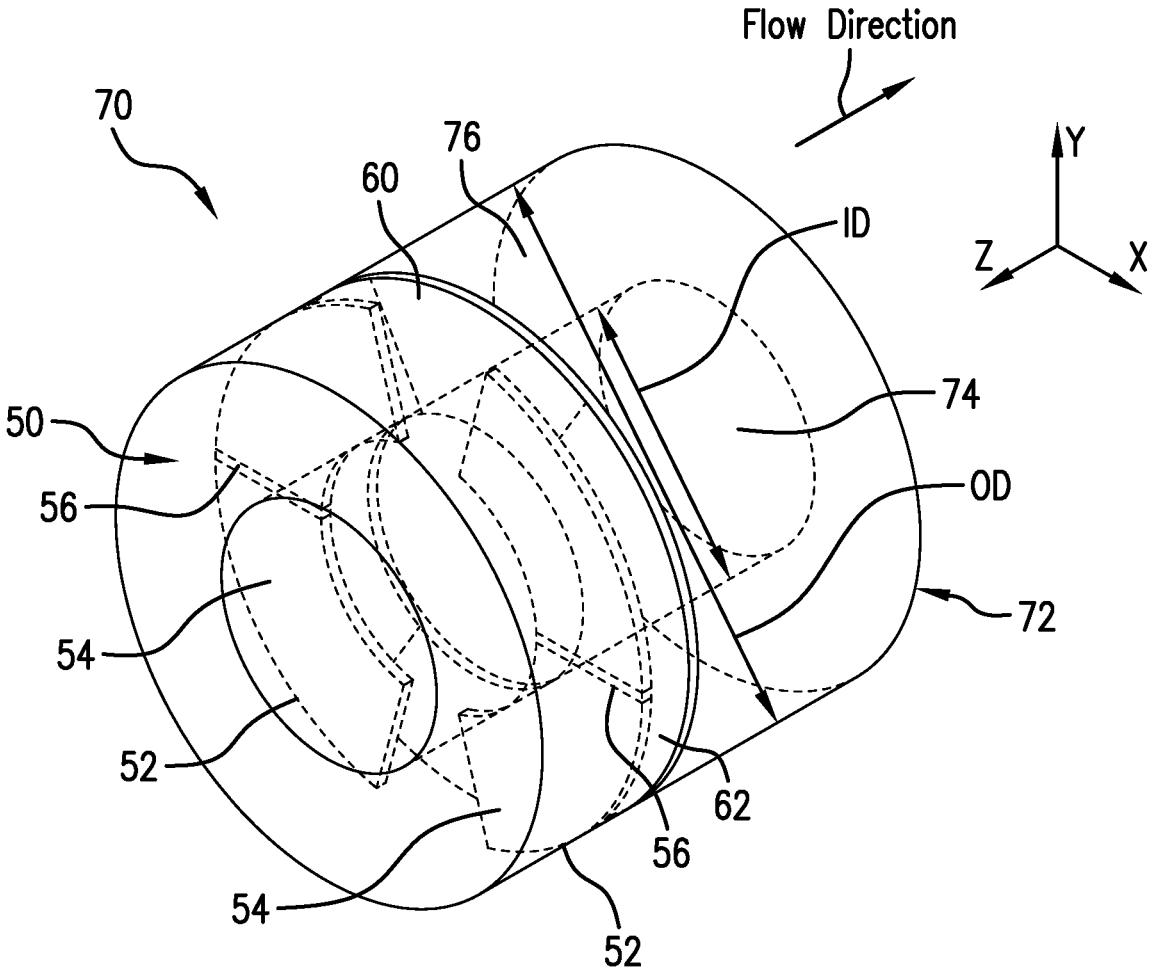
FIG. 4 is a perspective view of an embodiment of a flow control device having an annular fluid channel and a restriction assembly including a cantilever device.
Figure 5:
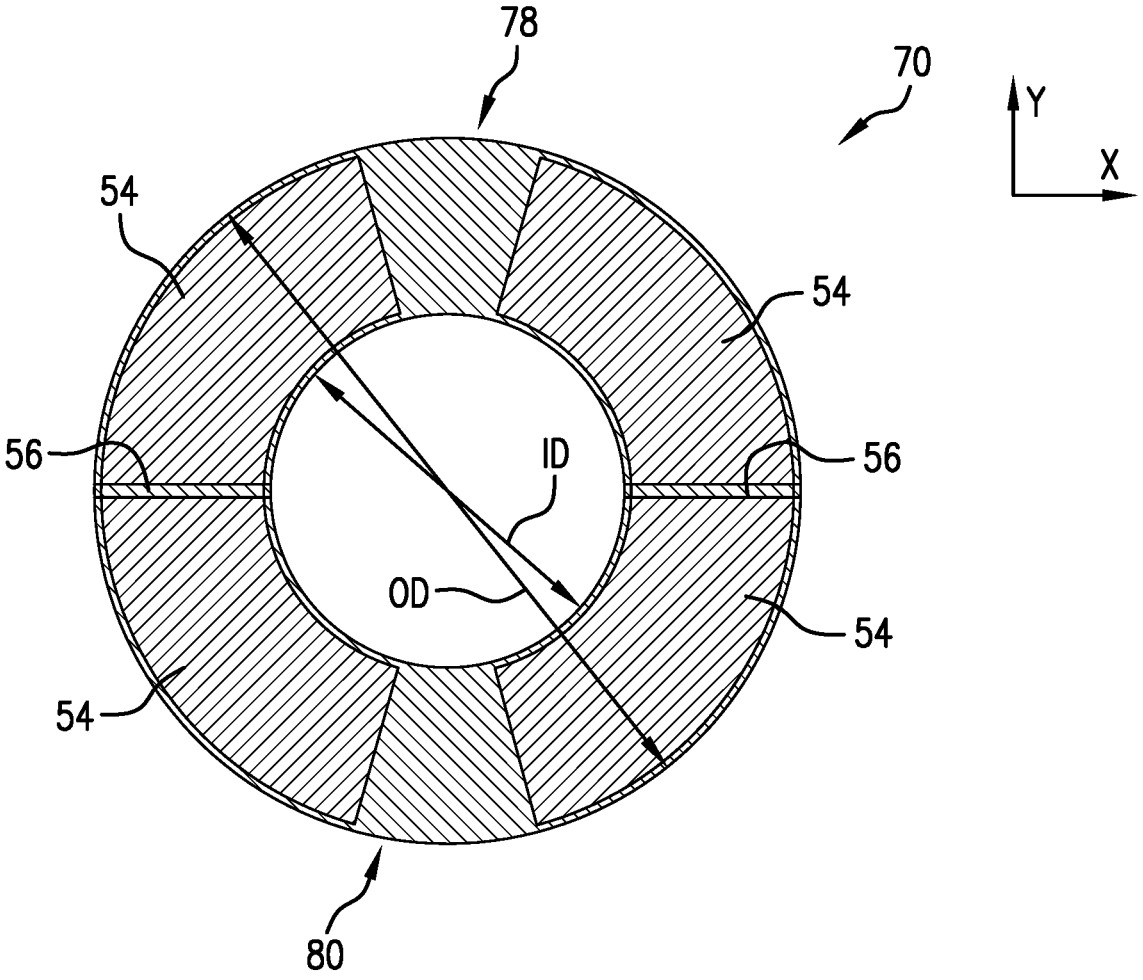
FIG. 5 is a front view of the flow control device of FIG. 4.
Figure 6:
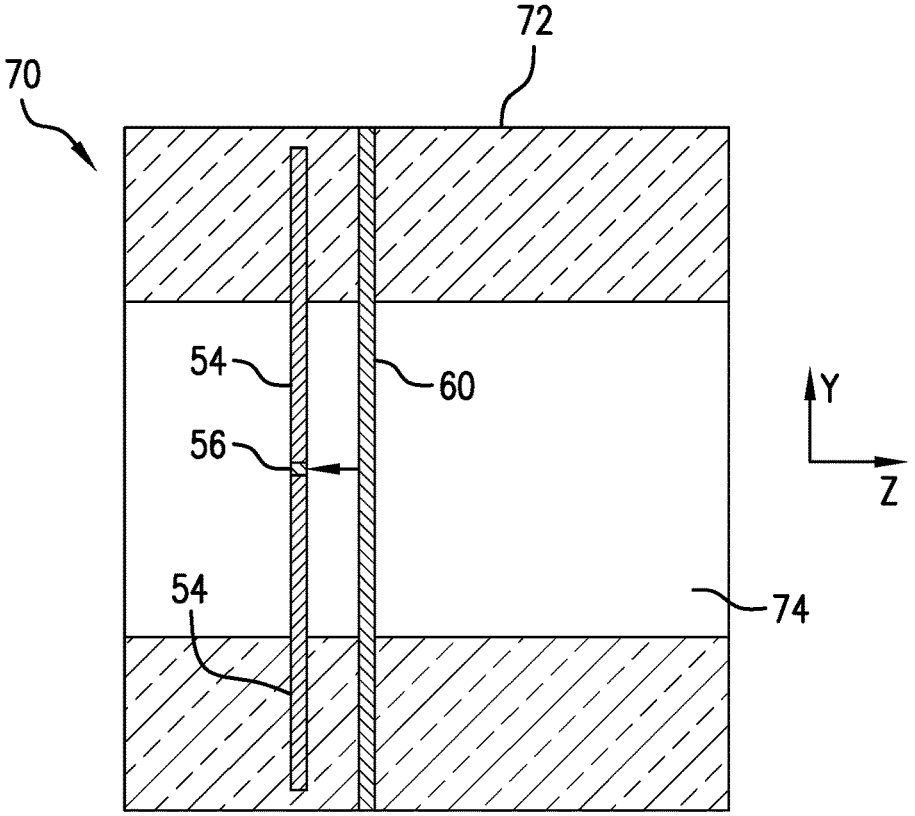
FIG. 6 is a side view of the flow control device of FIG. 4.
Figure 7:
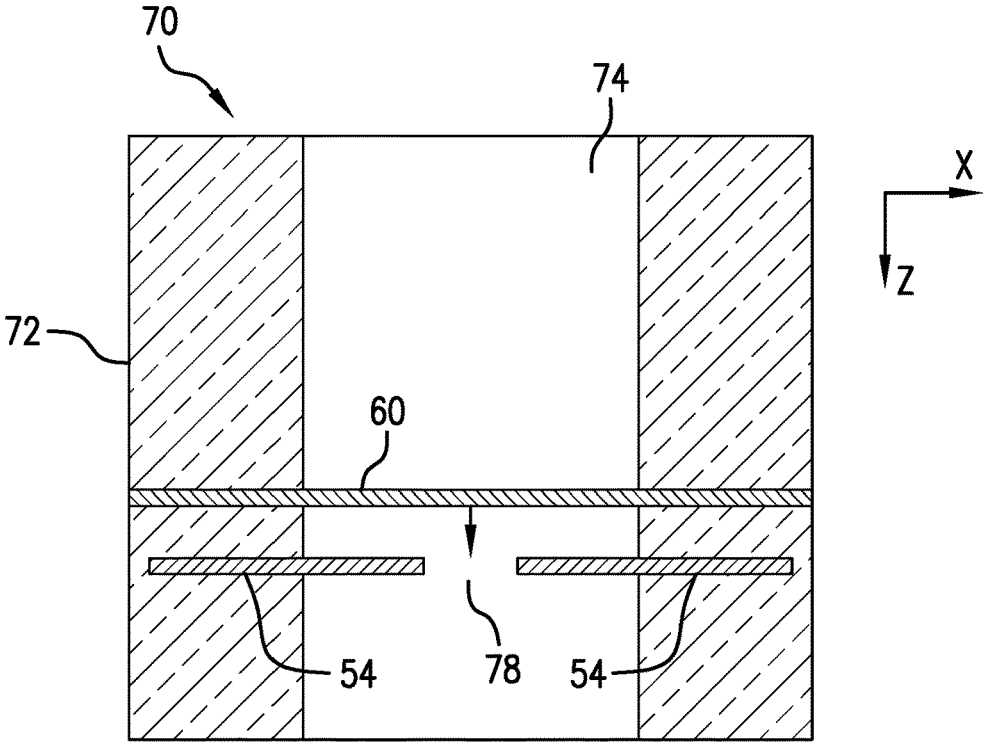
FIG. 7 is a side view of the flow control device of FIG. 4.
Figure 8:
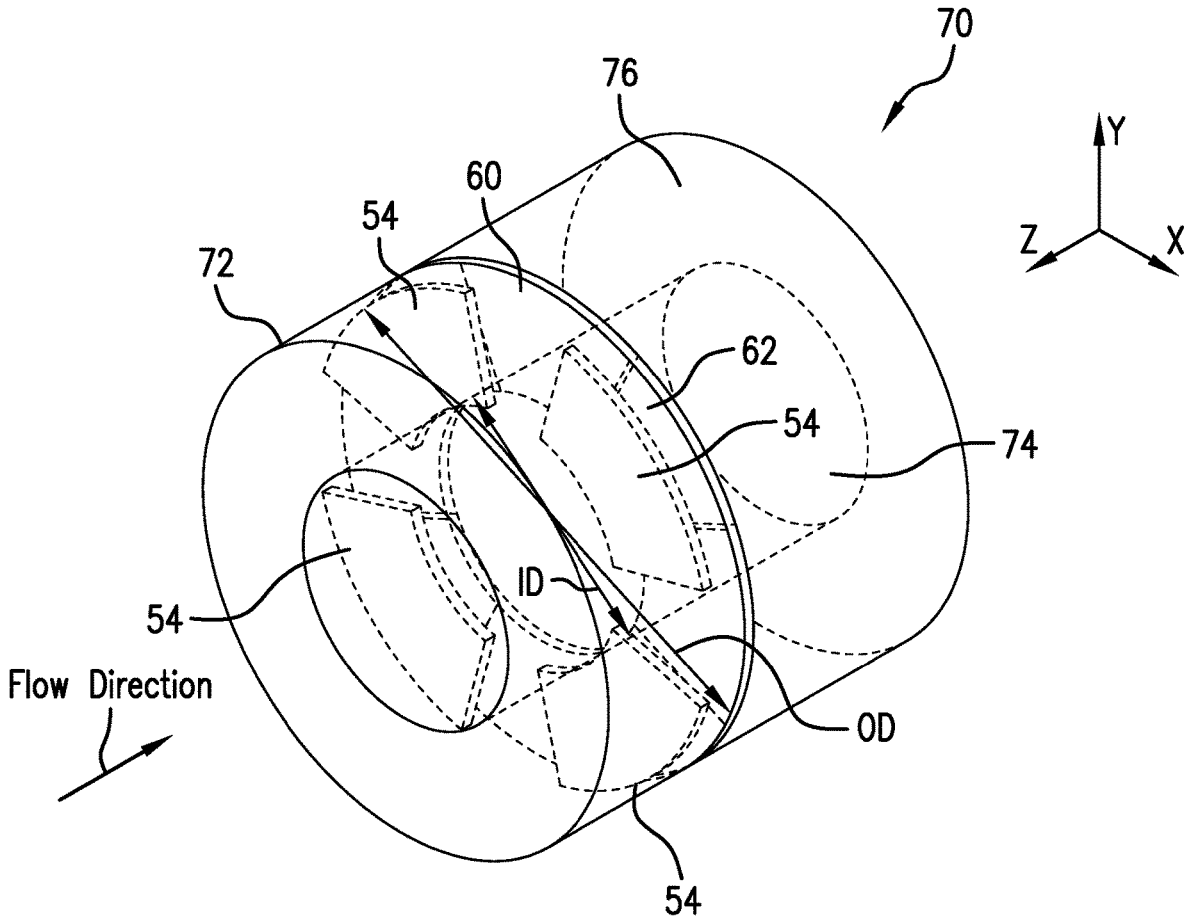
FIG. 8 is a perspective view of an embodiment of a flow control device having an annular fluid channel and a restriction assembly including a cantilever device.
Figure 9:
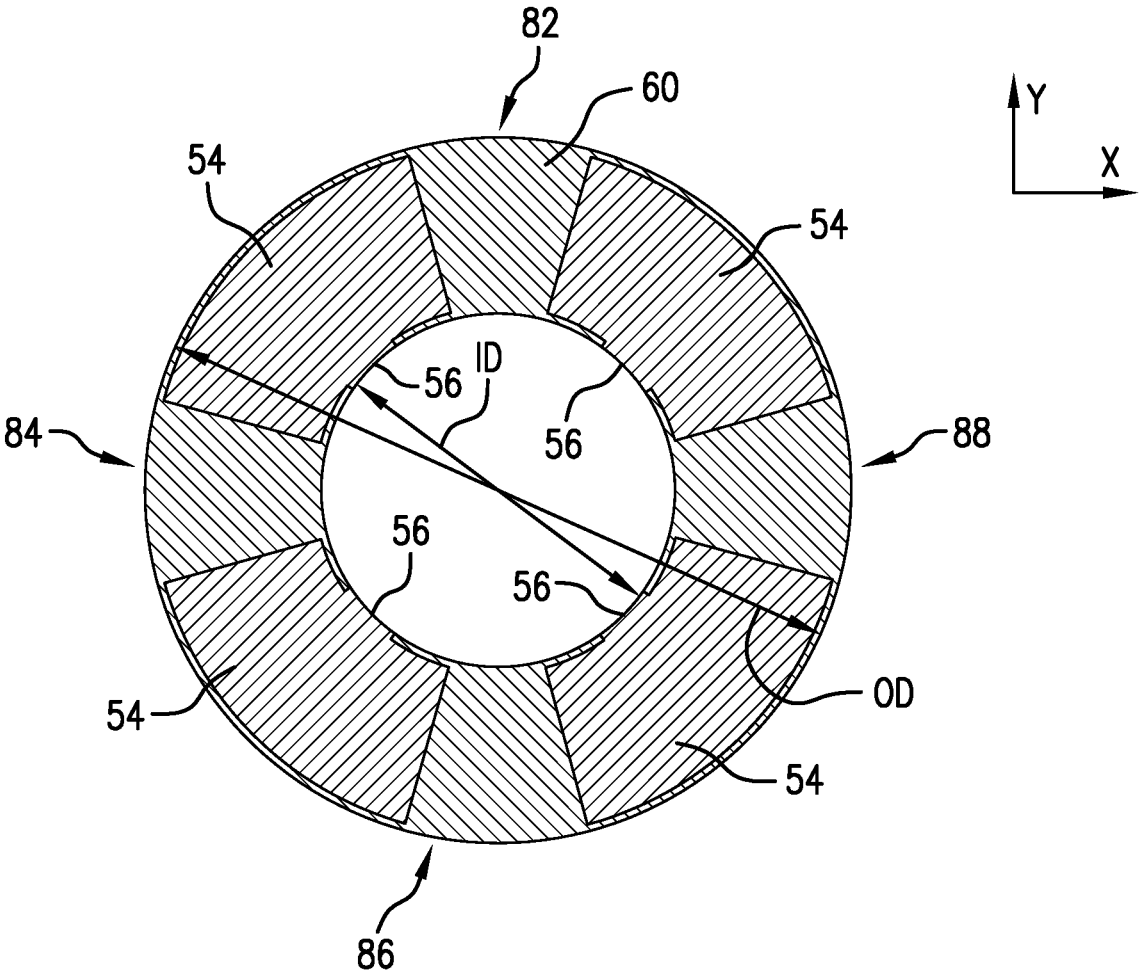
FIG. 9 is a front view of the flow control device of FIG. 8.
Figure 10:
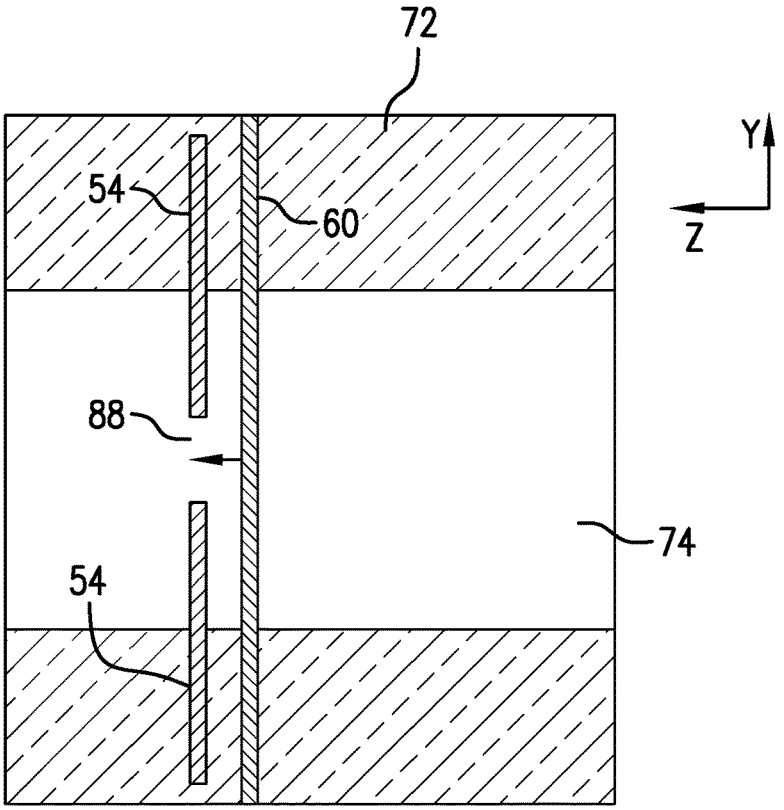
FIG. 10 is a side view of the flow control device of FIG. 8.
Figure 11:
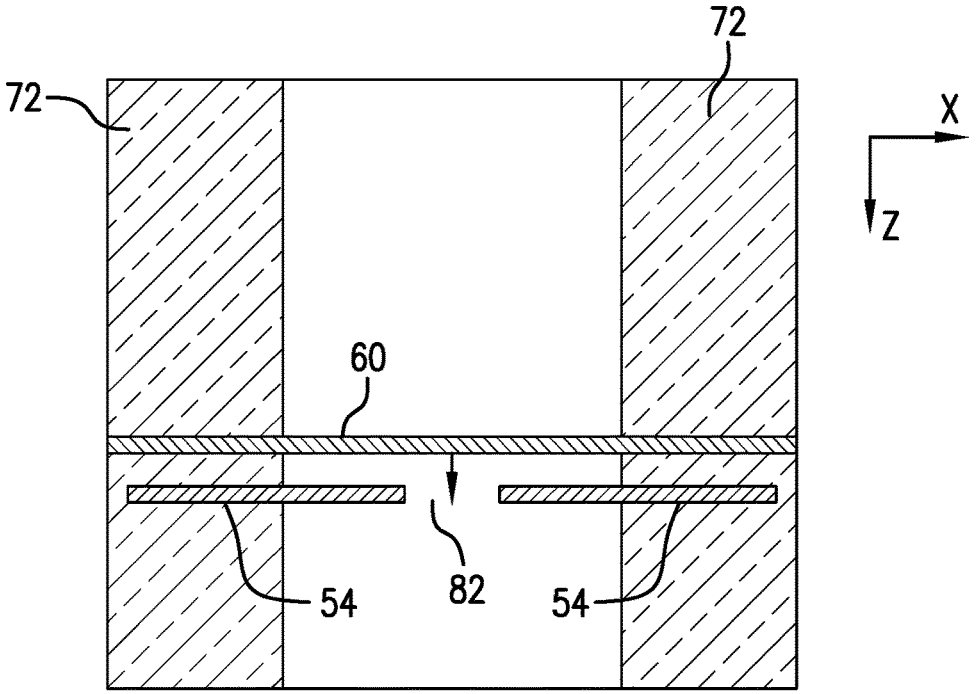
FIG. 11 is a side view of the flow control device of FIG. 8.

The rigid flow control body 60 is positioned axially (in the direction of fluid flow through the fluid channel 76) downstream from the cantilever devices 52. In this example, the rigid flow control body 60 is a flat, ring-shaped disc having two fluid ports 62. As shown in FIGS. 4 and 5, the rigid control body 60 is configured so that the fluid ports 62 are circumferentially offset from the gaps 78 and 80. This configuration provides a relatively tortuous path that is configured to further restrict flow rates.

The gaps 78 and 80, in combination with the fluid ports 62, define a restricted path having a minimum flow area. In use, when fluid flowing through the fluid channel 76 has a sufficient density for a given flow rate, the restricted path and the minimum flow area or throat is reduced or blocked off entirely due to the cantilever bodies 54 deflecting toward the flow control body 60.

FIGS. 8-11 depict a section of another example of the ICD 70. In this example, four cantilever devices 52 are formed from cantilever bodies 54 that each extend partially circumferentially around the central fluid conduit 74. Each body 54 has an attachment portion 56 that is integral to thereto, protrudes radially inwardly, and is fixedly attached to an outer surface of the fluid channel 76. The cantilever bodies 54 define four gaps 82, 84, 86 and 88.

The rigid flow control body 60 is a flat, ring-shaped disc that is positioned axially downstream from the cantilever devices 52, and forms four ports 62 that are circumferentially offset from the gaps 82, 84, 86 and 88. The gaps 82, 84, 86 and 88, in combination with the fluid ports 62, define a restricted path that can be reduced or blocked off as discussed above. In use, when fluid flowing through the fluid channel 76 has a sufficient density for a given flow rate, the restricted path is reduced or blocked off entirely due to the cantilever bodies 54 deflecting toward respective rigid flow control bodies 60.

Figure 12:
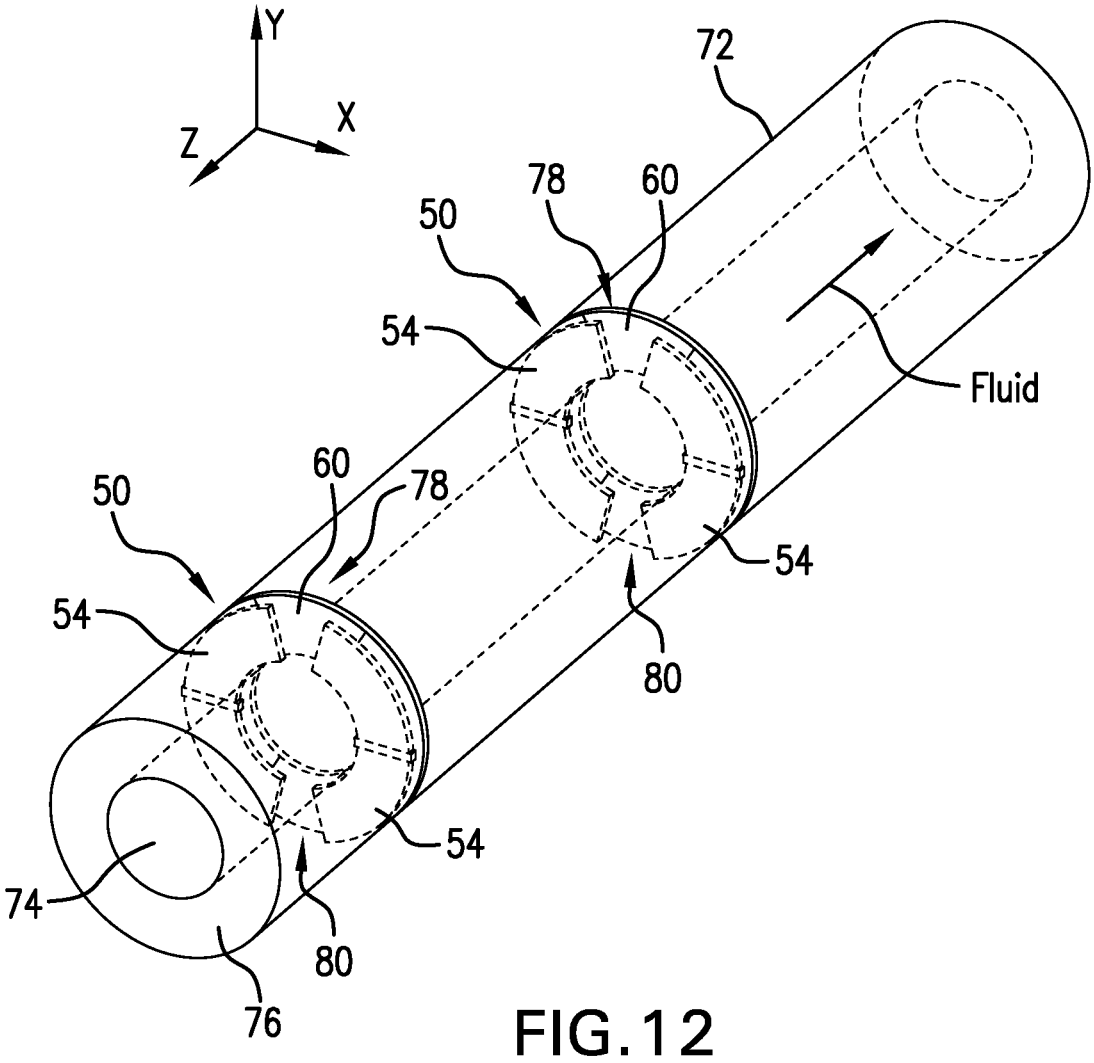
FIG. 12 depicts an embodiment of a multi-stage flow control device.
Figure 13:
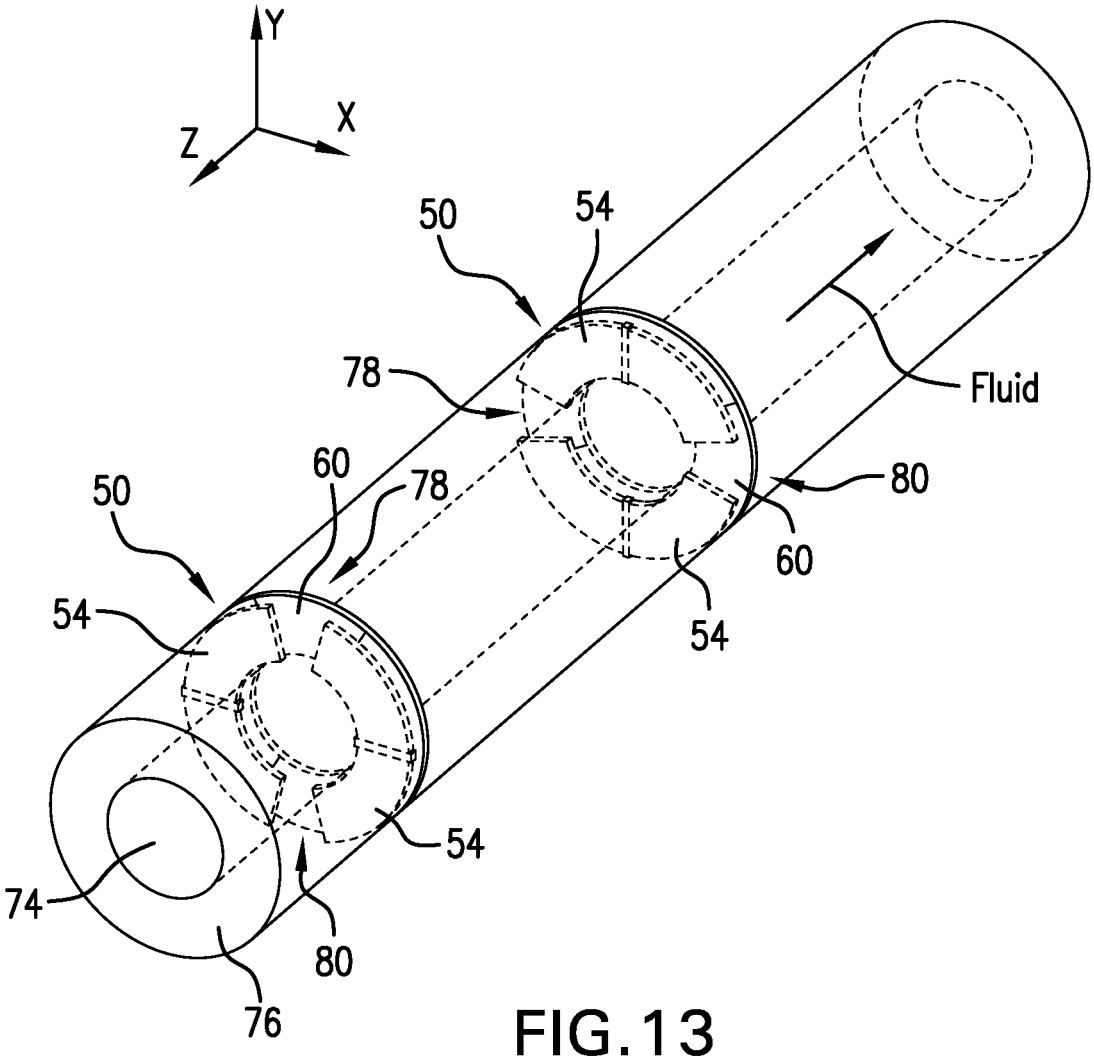
FIG. 13 depicts an embodiment of a multi-stage flow control device.

FIGS. 12 and 13 depict examples of the ICD 70, each of which has a different configuration of flow control assemblies 50. Each flow control assembly 50 defines a flow control stage. The flow control assemblies 50 at each stage may have the same material and geometric properties, so that each stage responds similarly to a given flow rate and density. Alternatively, each stage can be configured to respond differently. For example, one stage may include cantilever bodies 54 that exhibit different degrees of bending for a given flow rate and/or density.

In the example of FIG. 12, the flow control assemblies 50 are configured so that the gaps 78 and 80, and the fluid ports 62 are oriented to the same or similar circumferential position. In the example of FIG. 13, the flow control assemblies 50 are configured so that the gaps 78 and 80, and the fluid ports 62 in one assembly 50 are circumferentially offset or rotated relative to those of another assembly 50.

In the above examples, the cantilever bodies 54 and the rigid flow control components 60 are configured as flat, and ring-shaped or partially ring-shaped, discs. It is noted that the embodiments described herein are not so limited, and components thereof can have any suitable shape and size to establish a restricted flow path that can be adjusted or closed due to cantilever deformation or deflection.

The flow control devices described herein can be used in conjunction with a method of producing a target resource such as hydrocarbons from a resource bearing formation, and controlling inflow of production fluid. The method is described in conjunction with the system 10 and production assembly 30 of FIG. 1, but is not so limited and can be performed in conjunction with any production system or other system for which fluid flow control is desired.

Initially, the borehole string 12 and the production assembly 30 are deployed into the borehole 14. Deployment of the production assembly may be performed prior to, during and/or after various operations, such as a drilling, stimulation, fracturing, completion and/or measurement operation. The production assembly 30 includes one or more flow control devices 32 (e.g., ICDs) configured to control fluid flow based on fluid properties such as flow rate and density. Production fluid flows from a formation region around the production assembly 30 and into the flow control devices 32. The flow rate through the flow control devices 32 is controlled passively by respective cantilever devices 52 based on, for example, the density of fluid, so that production fluid having more than a selected proportion of water (and/or other undesired fluids) is restricted or choked. Production fluid that is permitted to flow through the flow control devices 32 is brought to the surface via the borehole string 12.

Set forth below are some embodiments of the foregoing disclosure:

Embodiment 1: A fluid flow control device comprising: a housing; a fluid channel defined within the housing, the fluid channel having an inlet; and a restriction assembly including a cantilever device disposed within the fluid channel and defining a restricted fluid path, the cantilever device configured to deform to reduce an area of the restricted fluid path and restrict a flow rate of fluid flowing therethrough based on a property of the fluid.

Embodiment 2: The flow control device of any prior embodiment, wherein the cantilever device includes a cantilever body and an attachment portion, the attachment portion fixedly disposed relative to the fluid channel, the cantilever body having a geometric property and a material property selected to cause the cantilever body to deflect based on the property of the fluid being at or above a selected threshold.

Embodiment 3: The flow control device of any prior embodiment, wherein the fluid property includes a fluid density and a fluid flow rate.

Embodiment 4: The flow control device of any prior embodiment, wherein the flow control device is configured to be disposed in a borehole and receive production fluid from a subterranean region, and the selected threshold is a threshold fluid density, the threshold fluid density based on a proportion of hydrocarbon fluid in the production fluid.

Embodiment 5: The flow control device of any prior embodiment, further comprising a rigid flow control component disposed in the fluid channel downstream of the cantilever device, the rigid flow control component having a fluid port configured to permit fluid flow therethrough.

Embodiment 6: The flow control device of any prior embodiment, wherein the cantilever device is configured to deflect in a direction of fluid flow through the fluid channel and toward the rigid flow control component, to reduce the area of the restricted flow path.

Embodiment 7: The flow control device of any prior embodiment, wherein the fluid channel is an annular fluid channel at least partially surrounding a central fluid conduit, and the cantilever body is an annular body disposed in the annular fluid channel.

Embodiment 8: The flow control device of any prior embodiment, wherein the annular fluid channel includes an inlet in fluid communication with an annular region of the borehole surrounding an exterior surface of the housing, and an outlet in fluid communication with the central fluid conduit.

Embodiment 9: The flow control device of any prior embodiment, further comprising a plurality of restriction assemblies disposed in the fluid channel, each restriction assembly of the plurality of restriction assemblies having a respective cantilever device configured to deform based on a different value of the property of the fluid.

Embodiment 10: The flow control device of any prior embodiment, wherein the fluid control device is at least part of an inflow control device configured to be disposed in a borehole, the inflow control device configured to receive production fluid.

Embodiment 11: A method of controlling fluid flow, comprising: receiving fluid at an inlet of a fluid channel in a housing of a flow control device, the fluid channel defined within the housing; controlling a flow rate of the fluid through the fluid channel by a restriction assembly, the restriction assembly including a cantilever device disposed within the fluid channel and defining a restricted fluid path, wherein the controlling includes deforming the cantilever device to reduce an area of the restricted fluid path and restrict the flow rate of the fluid based on a property of the fluid.

Embodiment 12: The method of any prior embodiment, wherein the cantilever device includes a cantilever body and an attachment portion, the attachment portion fixedly disposed relative to the fluid channel, the cantilever body having a geometric property and a material property selected to cause the cantilever body to deflect based on the property of the fluid being at or above a selected threshold.

Embodiment 13: The method of any prior embodiment, wherein the fluid property includes a fluid density and a fluid flow rate.

Embodiment 14: The method of any prior embodiment, wherein the flow control device is disposed in a borehole, the fluid includes a production fluid from a subterranean region, and the selected threshold is a threshold fluid density, the threshold fluid density based on a proportion of hydrocarbon fluid in the production fluid.

Embodiment 15: The method of any prior embodiment, wherein the restriction assembly includes a rigid flow control component disposed in the fluid channel downstream of the cantilever device, the rigid flow control component having a fluid port configured to permit fluid flow therethrough.

Embodiment 16: The method of any prior embodiment, wherein deforming the cantilever device includes deflecting the cantilever device in a direction of fluid flow through the fluid channel and toward the rigid flow control component, to reduce the area of the restricted flow path.

Embodiment 17: The method of any prior embodiment, wherein the fluid channel is an annular fluid channel at least partially surrounding a central fluid conduit, and the cantilever body is an annular body disposed in the annular fluid channel.

Embodiment 18: The method of any prior embodiment, wherein the annular fluid channel includes an inlet in fluid communication with an annular region of the borehole surrounding an exterior surface of the housing, and an outlet in fluid communication with the central fluid conduit.

Embodiment 19: The method of any prior embodiment, further comprising a plurality of restriction assemblies disposed in the fluid channel, each restriction assembly of the plurality of restriction assemblies having a respective cantilever device configured to deform based on a different value of the property of the fluid.

Embodiment 20: The method of any prior embodiment, wherein the fluid control device is at least part of an inflow control device configured to be disposed in a borehole, the inflow control device configured to receive production fluid.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A fluid flow control device comprising:

a housing;

a fluid channel defined within the housing, the fluid channel having an inlet; and a restriction assembly including a cantilever device disposed within the fluid channel and defining a restricted fluid path, the cantilever device configured to deform to reduce an area of the restricted fluid path and restrict a flow rate of fluid flowing therethrough based on a property of the fluid, the property of the fluid including a density of the fluid, the cantilever device including a cantilever body having at least one of a geometric property and a material property selected to cause the cantilever body to deform based on the density of the fluid increasing above a selected threshold fluid density, the restriction assembly including a rigid flow control component disposed at an interior of the fluid channel, at least part of the restricted fluid path extending between the rigid flow control component and the cantilever body, wherein the cantilever body is configured to deflect toward the rigid flow control component to reduce the area of the restricted flow path, the cantilever body is configured to impinge on the rigid flow component based on the property of the fluid having a sufficient value.

2. The flow control device of claim 1, wherein the cantilever device includes the cantilever body and an attachment portion, the attachment portion fixedly disposed relative to the fluid channel, the geometric property and the material property selected to cause the cantilever body to deflect based on the density of the fluid being at or above the selected threshold fluid density.

3. The flow control device of claim 1, wherein the fluid property includes the density of the fluid and a fluid flow rate.

4. The flow control device of claim 1, wherein the flow control device is configured to be disposed in a borehole and receive production fluid from a subterranean region, and the selected threshold fluid density is based on a proportion of hydrocarbon fluid in the production fluid.

5. The flow control device of claim 1, wherein the rigid flow control component is disposed in the fluid channel downstream of the cantilever device, the rigid flow control component having a fluid port configured to permit fluid flow therethrough.

6. The flow control device of claim 5, wherein the cantilever device is configured to deflect in a direction of fluid flow through the fluid channel and toward the rigid flow control component, to reduce the area of the restricted flow path.

7. The flow control device of claim 4, wherein the fluid channel is an annular fluid channel at least partially surrounding a central fluid conduit, and the cantilever body is an annular body disposed in the annular fluid channel.

8. The flow control device of claim 1, wherein the fluid channel is an annular fluid channel at least partially surrounding an exterior surface of the housing, the restriction assembly including a first partially annular cantilever body and a second partially annular cantilever body, the first cantilever body and the second cantilever body defining a gap therebetween, the rigid flow control component including a fluid port that is circumferentially offset from the gap.

9. The flow control device of claim 1, further comprising a plurality of restriction assemblies including the restriction assembly, the plurality of restriction assemblies disposed in the fluid channel, each restriction assembly of the plurality of restriction assemblies having a respective cantilever device configured to exhibit a different degree of deflection in response to a value of the density of the fluid.

10. The flow control device of claim 1, wherein at least one of the material property and the geometric property is selected based on a drag force exerted by the fluid on the cantilever device, the drag force calculated based on the density of the fluid.

11. A method of controlling fluid flow, comprising:

receiving fluid at an inlet of a fluid channel in a housing of a flow control device, the fluid channel defined within the housing;

controlling a flow rate of the fluid through the fluid channel by a restriction assembly, the restriction assembly including a cantilever device disposed within the fluid channel and defining a restricted fluid path, wherein the controlling includes deforming the cantilever device to reduce an area of the restricted fluid path and restrict the flow rate of the fluid based on a property of the fluid, the property of the fluid including a density of the fluid, the cantilever device including a cantilever body having at least one of a geometric property and a material property selected to cause the cantilever body to deform based on the density of the fluid increasing above a selected threshold fluid density, the restriction assembly including a rigid flow control component disposed at an interior of the fluid channel, at least part of the restricted fluid path extending between the rigid flow control component and the cantilever body, wherein the cantilever body is configured to deflect toward the rigid flow control component to reduce the area of the restricted flow path, the cantilever body is configured to impinge on the rigid flow component based on the property of the fluid having a sufficient value.

12. The method of claim 11, wherein the cantilever device includes the cantilever body and an attachment portion, the attachment portion fixedly disposed relative to the fluid channel, the geometric property and the material property selected to cause the cantilever body to deflect based on the property density of the fluid being at or above the selected threshold fluid density.

13. The method of claim 11, wherein the fluid property includes the fluid density and a fluid flow rate.

14. The method of claim 11, wherein the flow control device is disposed in a borehole, the fluid includes a production fluid from a subterranean region, and the selected threshold fluid density is based on a proportion of hydrocarbon fluid in the production fluid.

15. The method of claim 12, wherein the rigid flow control component is disposed in the fluid channel downstream of the cantilever device, the rigid flow control component having a fluid port configured to permit fluid flow therethrough.

16. The method of claim 15, wherein deforming the cantilever device includes deflecting the cantilever device in a direction of fluid flow through the fluid channel and toward the rigid flow control component, to reduce the area of the restricted flow path.

17. The method of claim 14, wherein the fluid channel is an annular fluid channel at least partially surrounding a central fluid conduit, and the cantilever body is an annular body disposed in the annular fluid channel.

18. The method of claim 17, wherein the fluid channel is an annular fluid channel at least partially surrounding an exterior surface of the housing, the restriction assembly including a first partially annular cantilever body and a second partially annular cantilever body, the first cantilever body and the second cantilever body defining a gap therebetween, the rigid flow control component including a fluid port that is circumferentially offset from the gap.

19. The method of claim 11, further comprising a plurality of restriction assemblies including the restriction assembly, the plurality of restriction assemblies disposed in the fluid channel, each restriction assembly of the plurality of restriction assemblies having a respective cantilever device configured to deform exhibit a different degree of deflection in response to a value of the property of the fluid.

20. The method of claim 11, wherein the fluid control device is at least part of an inflow control device configured to be disposed in a borehole, the inflow control device configured to receive production fluid.

* * * * *